US009299526B2

(12) United States Patent
Sumant et al.

(10) Patent No.: US 9,299,526 B2
(45) Date of Patent: Mar. 29, 2016

(54) METHOD TO FABRICATE PORTABLE ELECTRON SOURCE BASED ON NITROGEN INCORPORATED ULTRANANOCRYSTALLINE DIAMOND (N-UNCD)

(71) Applicant: UChicago Argonne, LLC, Chicago, IL (US)

(72) Inventors: Anirudha V. Sumant, Plainfield, IL (US); Ralu Divan, Darien, IL (US); Chrystian M. Posada, Rolla, MO (US); Carlos H. Castano, Rolla, MO (US); Edwin J. Grant, Villa Ridge, MO (US); Hyoung K. Lee, Rolla, MO (US)

(73) Assignees: UChicago Argonne, LLC, Chicago, IL (US); The Curators of the University of Missouri, Columbia, MO (US)

( * ) Notice: Subject to any disclaimer, the term of this patent is extended or adjusted under 35 U.S.C. 154(b) by 11 days.

(21) Appl. No.: 14/261,680

(22) Filed: Apr. 25, 2014

(65) Prior Publication Data

US 2015/0311023 A1 Oct. 29, 2015

(51) Int. Cl.

| | |
|---|---|
| ***H01J 1/304*** | (2006.01) |
| ***H01J 9/02*** | (2006.01) |
| ***H01J 35/06*** | (2006.01) |

(52) U.S. Cl.

CPC ..... *H01J 1/304* (2013.01); *H01J 9/025* (2013.01); *H01J 35/065* (2013.01)

(58) Field of Classification Search

None

See application file for complete search history.

(56) References Cited

U.S. PATENT DOCUMENTS

| | | | | |
|---|---|---|---|---|
| 6,793,849 | B1 * | 9/2004 | Gruen et al. | 252/502 |
| 8,154,185 | B2 * | 4/2012 | Yang et al. | 313/311 |
| 2003/0002627 | A1 * | 1/2003 | Espinosa et al. | 378/136 |
| 2006/0131588 | A1 * | 6/2006 | Gruen et al. | 257/77 |
| 2006/0202609 | A1 * | 9/2006 | Jang et al. | 313/497 |
| 2008/0191598 | A1 * | 8/2008 | Yang et al. | 313/310 |
| 2010/0051964 | A1 * | 3/2010 | Lin et al. | 257/77 |
| 2011/0055987 | A1 * | 3/2011 | Moldovan | 850/40 |
| 2012/0193684 | A1 * | 8/2012 | Sumant et al. | 257/254 |
| 2013/0187123 | A1 * | 7/2013 | Kalish et al. | 257/10 |
| 2013/0230146 | A1 * | 9/2013 | Kim et al. | 378/122 |
| 2014/0185739 | A1 * | 7/2014 | Tang et al. | 378/4 |
| 2014/0212763 | A1 * | 7/2014 | Tzeng et al. | 429/232 |

OTHER PUBLICATIONS

Bhattacharyya, S., et al., "Synthesis and characterization of highly-conducting nitrogen-doped ultrananocrystalline diamond films," Applied Physics Letters, vol. 79, No. 10, Sep. 3, 2001, pp. 1441-1443.

(Continued)

*Primary Examiner* — Ashok Patel

(74) *Attorney, Agent, or Firm* — Foley & Lardner LLP

(57) ABSTRACT

A source cold cathode field emission array (FEA) source based on ultra-nanocrystalline diamond (UNCD) field emitters. This system was constructed as an alternative for detection of obscured objects and material. Depending on the geometry of the given situation a flat-panel source can be used in tomography, radiography, or tomosynthesis. Furthermore, the unit can be used as a portable electron or X-ray scanner or an integral part of an existing detection system. UNCD field emitters show great field emission output and can be deposited over large areas as the case with carbon nanotube "forest" (CNT) cathodes. Furthermore, UNCDs have better mechanical and thermal properties as compared to CNT tips which further extend the lifetime of UNCD based FEA.

16 Claims, 8 Drawing Sheets

(56) References Cited

OTHER PUBLICATIONS

Getty, S., et al., "Characterization of Nitrogen-Incorporated Ultrananocrystalline Diamond as a Robust Cold Cathode Material," Proc. of SPIE, 2010, vol. 7679, 7 pages.

Grant, E.J., et al., "Construction of a Ultrananocrystalline Diamond based Cold Cathode Arrays for a Flat-Panel X-ray Source," Proc. of SPIE, 2013, vol. 8709, 9 pages.

Posada, C., et al., "Nitrogen incorporated ultrananocrystalline diamond based field emitter array for a flat-panel x-ray source," Journal of Applied Physics, 2014, vol. 115, No. 134506, 9 pages.

* cited by examiner

FIGURES 6(a)-(b)

METHOD TO FABRICATE PORTABLE ELECTRON SOURCE BASED ON NITROGEN INCORPORATED ULTRANANOCRYSTALLINE DIAMOND (N-UNCD)

STATEMENT OF GOVERNMENT INTEREST

The United States Government claims certain rights in this invention pursuant to Contract No. DE-AC02-06CH11357 between the U.S. Department of Energy and UChicago Argonne, LLC as operator of Argonne National Laboratories and also pursuant to Grant No. N6601-12-1-4237 from DARPA.

BACKGROUND OF THE INVENTION

X-ray tube technologies have not changed drastically since 1895, with two general common design features: thermionic electron emission and a single focal spot design. These characteristics make heat dissipation in the X-ray target on important operational problem. In addition, X-rays generated from a single focal point yield a widely diverging X-ray coaxially shaped beam, leading to geometric distortion of the medical anatomy or internal 3D structures of imaged objects due to magnification.

SUMMARY OF THE INVENTION

An improved X-ray source design provides a method and article of manufacture, which was developed that uses multiple electron sources, and is distributed in a 2D array instead of just a single focal spot. Also, the method and article of manufacture replaces thermionic electron emission with electron field emission. The use of field emission has not gained much attention in terms of X-ray tube technology in the recent past. The biggest hurdle has been the fabrication of a stable field emission source of electrons, and the microfabrication techniques required did not exist until the last several decades. The benefits of field emission are appealing when compared to thermionic emission such as lower power consumption and higher brightness. Additionally, there are several different designs and materials used in cold cathodes, ranging from the original Spindt type emitters with molybdenum pyramidal tips to gated tips. Furthermore, cold cathodes made from carbon based materials like carbon nanotubes ("CNT") and diamond have been heavily researched. However, field emission properties from ultra-nanocrystalline diamond ("UNCD") are very good even with planar geometry without the need for coating them onto high aspect ratio tips, which simplifies the microfabrication process. These and other features of the invention will be described in more detail hereinafter with reference to the figures described below.

BRIEF DESCRIPTION OF THE DRAWINGS

FIG. 2(*a*) shows a Si wafer with $Si_3N_4$, W, N-UNCD and photoresist; FIG. 2(*b*) shows a UV lithography mask 1 and Ti mask;

FIG. 2(*c*) shows PR removal and N-UNCD etch; FIG. 2(*d*) shows Ti mask removal and PR layer for tungsten etch; FIG. 2(*e*) shows UV lithography mask 2 and tungsten etch; FIG. 2(*f*) shows 5 microns of $SiO_2$ for electrical insulation; FIG. 2(*g*) shows a W seed layer for Cu electroplating; FIG. 2(*h*) shows PR layer and UV mask 3 lithography for the W seed layer etch; FIG. 2(*i*) shows an etch of a W seed layer; FIG. 2(*j*) shows a negative PR UV lithography mask 3 for Cu electroplating control; FIG. 2(*k*) shows electroplate of Cu using negative PR as growth mold; and FIG. 2(*l*) shows a BOE etch of $SiO_2$ under Cu grid for field emission;

DETAILED DESCRIPTION OF PREFERRED EMBODIMENTS

Figure 1:
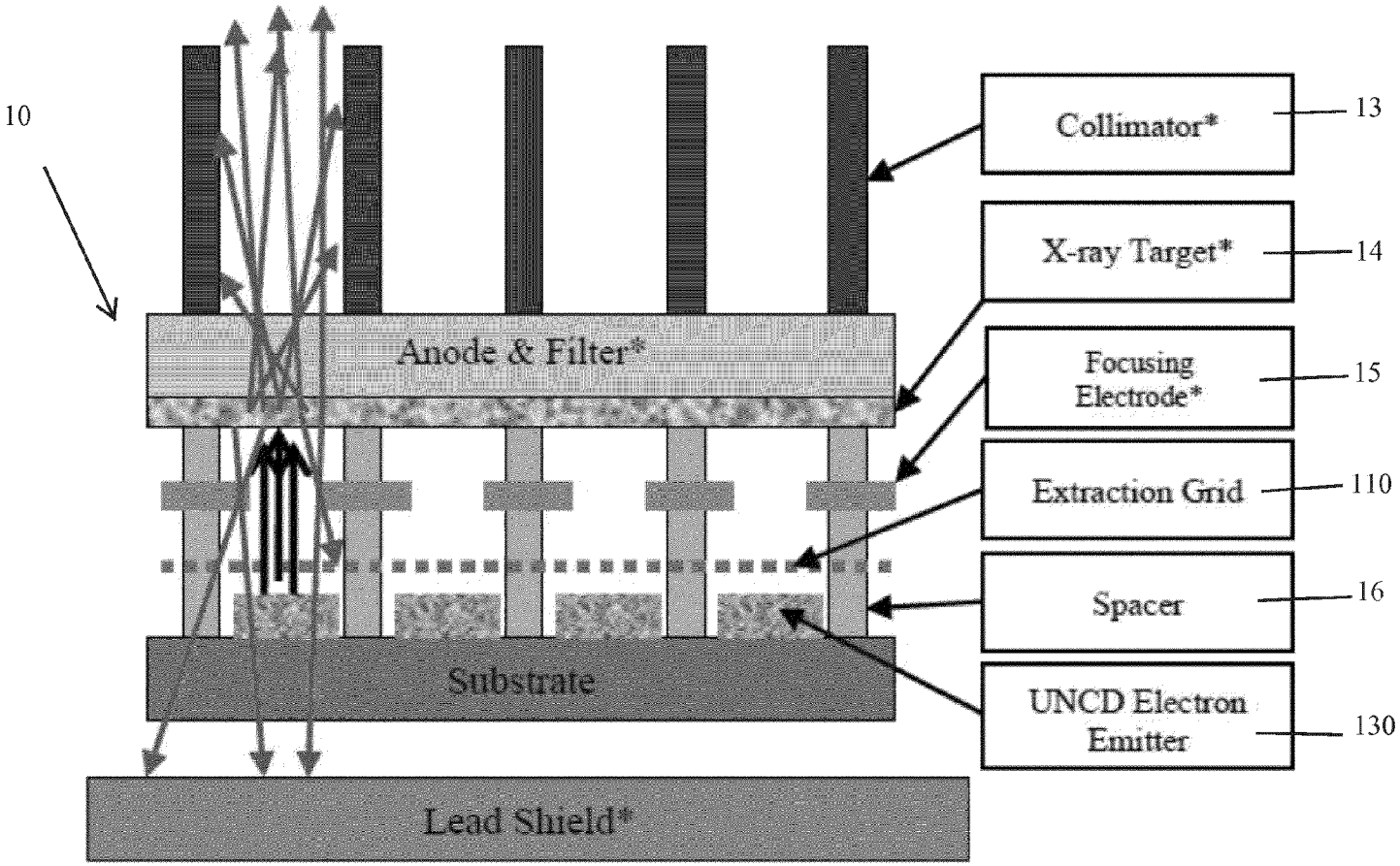
FIG. 1 shows a cross-sectional view of a preferred form of a flat-panel X-ray source design (the drawing is not to scale); the field emitter arrays shown herein only incorporate the substrate, UNCD emitters, spacer, and extraction grid with a focusing electrode, anode, X-ray target, and collimators not being included in the illustrated design (the lead shield components are not a part of the cathode fabrication)

In a preferred embodiment of the invention, a fabrication procedure is described for providing an article of manufacture of a 3×3 flat nitrogen-incorporated ultra-nanocrystalline diamond (N-UNCD) field emitter array ("FEA"). In the first part a preferred method of preparation is shown in FIG. 1 for a cathode-extraction grid 10. As will be discussed hereinafter, the cathode was developed using a microfabrication process that allows for individually addressable N-UNCD arrays. Electron field emission was demonstrated by applying a bias between a cathode and the monolithically integrated electron extraction grid, and these electron emission characterization results and device structure are detailed hereinafter. The X-ray system shown in FIG. 1 further includes a collimator 13, an X-ray target 14, a focusing electrode 15, a spacer 16, a lead shield 17 and with further components detailed hereinafter.

Figures 2A, 2B, 2C, 2D, 2E, 2F, 2G, 2H, 2I, 2J, 2K, 2L:
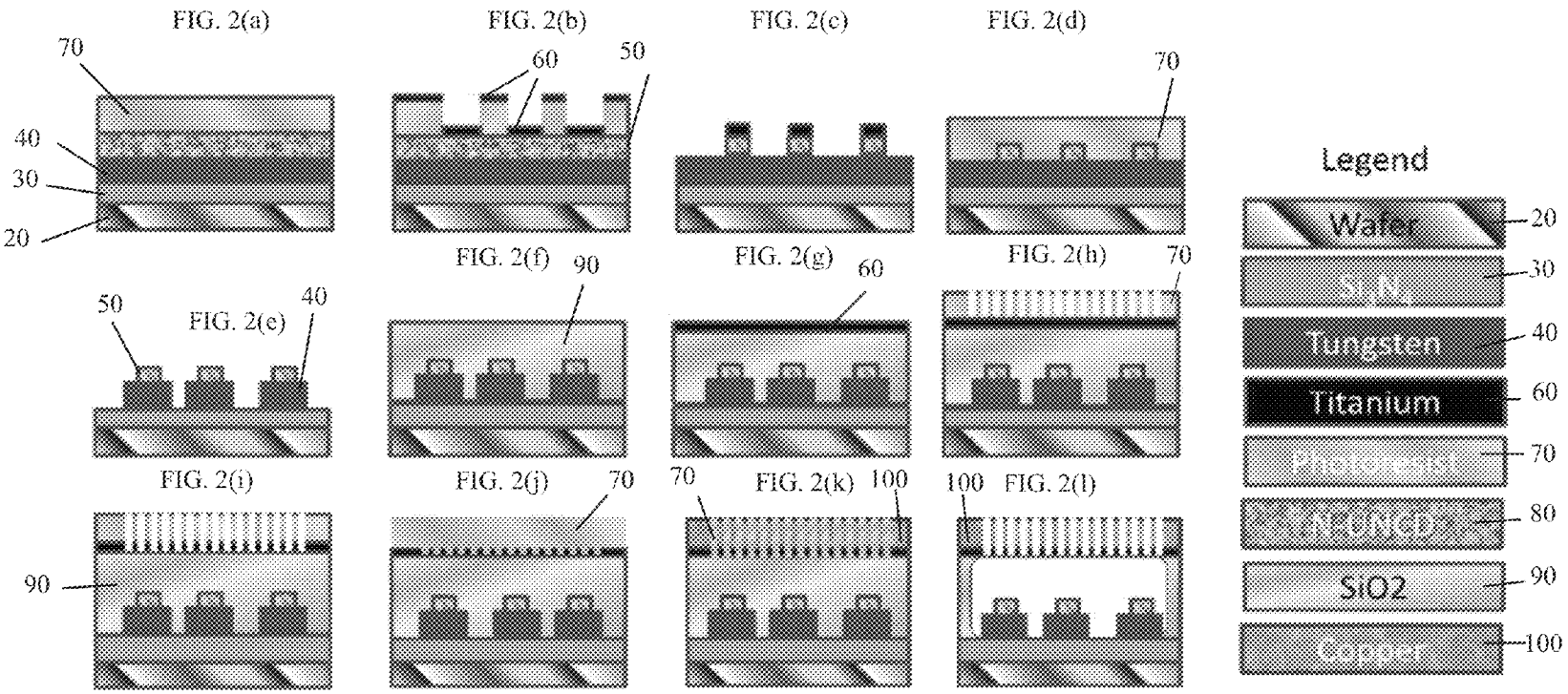
FIGS. 2(*a*)-(*l*) show a microfabrication flow chart.

The FEA component was most preferably carried out by monolithical fabrication using microfabrication techniques; and the process flow schematic is shown in FIGS. 2(*a*)-(*l*). In the first steps of a preferred fabrication process shown in FIGS. 2(*a*)-2(*c*), p-type (100) Si wafers 20 were coated with a low stress 1 micrometer $Si_3N_4$ layer 30 preferably deposited by low-pressure chemical vapor deposition (LPCVD). This $Si_3N_4$ layer 30 serves as an electrical insulation layer between the base wafer 20 and the electron emitters. Next, a thin tungsten layer 40 (about 250 nm thick) is sputtered onto the $Si_3N_4$ layer 30 for electrical connection to an N-UNCD emitters 50 (see FIG. 3). Tungsten for the layer 40 was selected for its ability to withstand the high temperatures (850° C.) required for the N-UNCD growth process; and it also serves as a good seed layer for the N-UNCD growth. Other like performing refractory metals can also be used. The metal deposition was preferably done using a magnetron sputtering system (such as a system from AJA International Inc.) or by using a Lesker PVD-250 electron-beam evaporator. The N-UNCD growth was done in a microwave plasma assisted chemical vapor deposition (MPCVD) system (such as, a 915 MHz large-area MPCVD system—Lambda Technologies Inc.). To obtain a hard mask for pattern transfer in N-UNCD, a 50 nm titanium layer 60 was deposited by e-beam evaporation after UV lithography. For patterning, a 2.7-μm-thick S1827 for example, (Shipley) photoresist layer 70 was spin coated at 3000 rpm, baked at 115° C. for 1 min and exposed using a Karl Suss MA-6 mask aligner. The pattern was developed in 351 Microposit developer diluted 1:3 in deionized water (DIW) for 20 s. Lift-off of the Ti layer 60 was done at 100° C. in standard 1165 remover for 3 hours, following a 90 second ultrasonic bath. The N-UNCD layer 50 was etched by a conventional ICP-RIE PlasmaLab 100, using oxygen 50 sccm, a chamber pressure 10 mTorr, at 1200 W ICP power and 10 W RF power (etching rate—50 nm $min^{-5}$). After etching the N-UNCD layer 50, a solution of HF and $H_2O$, with a ratio of 1:9 was used to remove the Ti hard mask layer 60.

Figure 3:
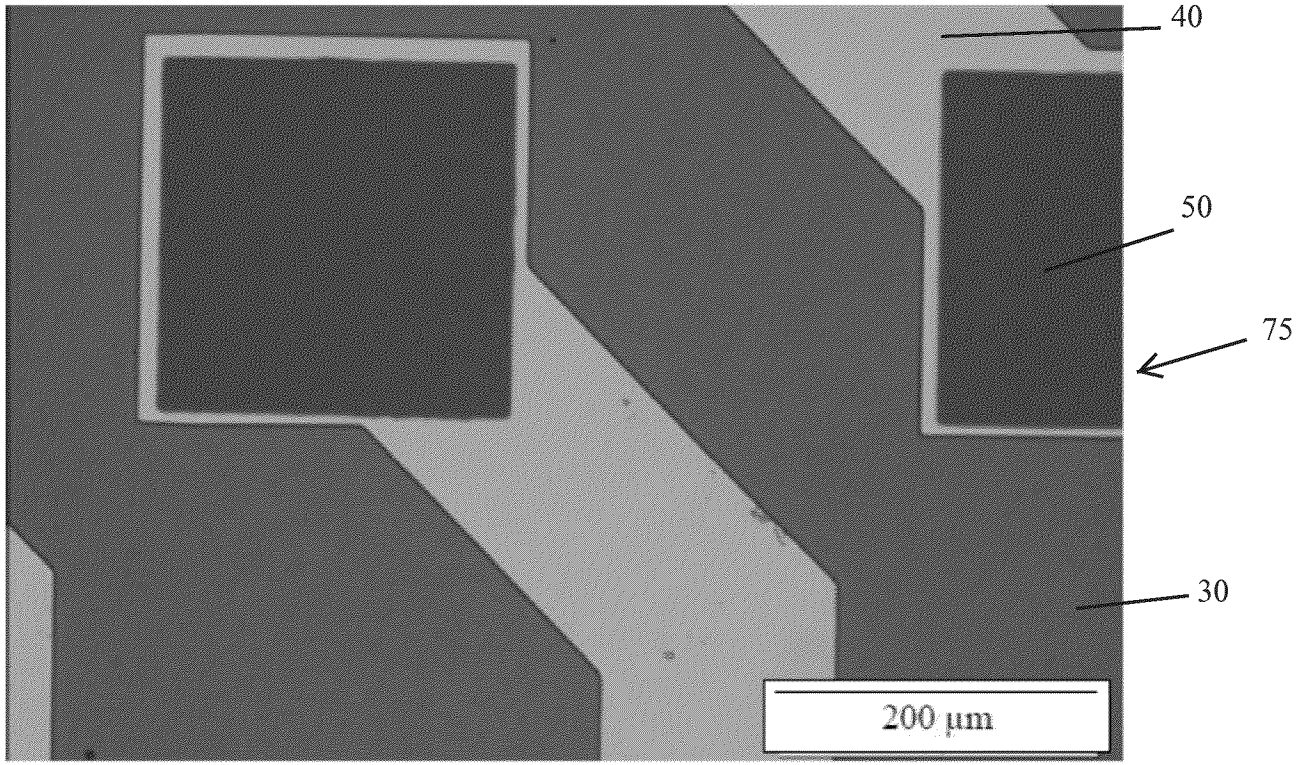
FIG. 3 shows a micro fabrication tungsten voltage lines with N-UNCD electron emitters aligned upon them; the tungsten was sputtered upon a $Si_3N_4$ insulating layer.

The next steps shown in FIGS. 2(*d*)-(*e*) were to create the tungsten electrical wiring circuit suitable for individually addressable pixels. This step was completed by UV optical lithography, using a maN-415 (Microchem) negative photoresist. This photoresist layer 70 was spin-coated at 3000 rpm and baked at 100° C. for 90 s, a 1.5-μm thick layer 70 was obtained. The tungsten layer 40 was etched by $SF_6$ RIE (CS 1700 March) at 20 sccm, 150 mTorr chamber pressure, 250 W RF power, and with an etching rate of about 80 nm min. After etching, the photoresist was removed with acetone. A sample of the tungsten wiring circuit 75 is shown in FIG. 3. Once the tungsten wiring scheme was finished, the base cathode fabrication was completed.

The next step was to make the electron extraction grid as shown by FIGS. 2(*f*)-2(*l*). In order to integrate the electron extraction grid, a standoff and electrically insulating layer was needed; due to its high dielectric strength a $SiO_2$ layer 90 was selected for this step. For a thickness greater than 1 μm, the $SiO_2$ layer 90 was deposited by plasma enhanced chemical vapor deposition (PECVD) at a low temperature of 100° C. (ICP CVD Oxford). During fabrication, a 5 μm limit was established due to a phenomenon in which deposited $SiO_2$ on the chamber walls of the deposition system started to flake off and contaminate the wafer surface.

Figure 4:
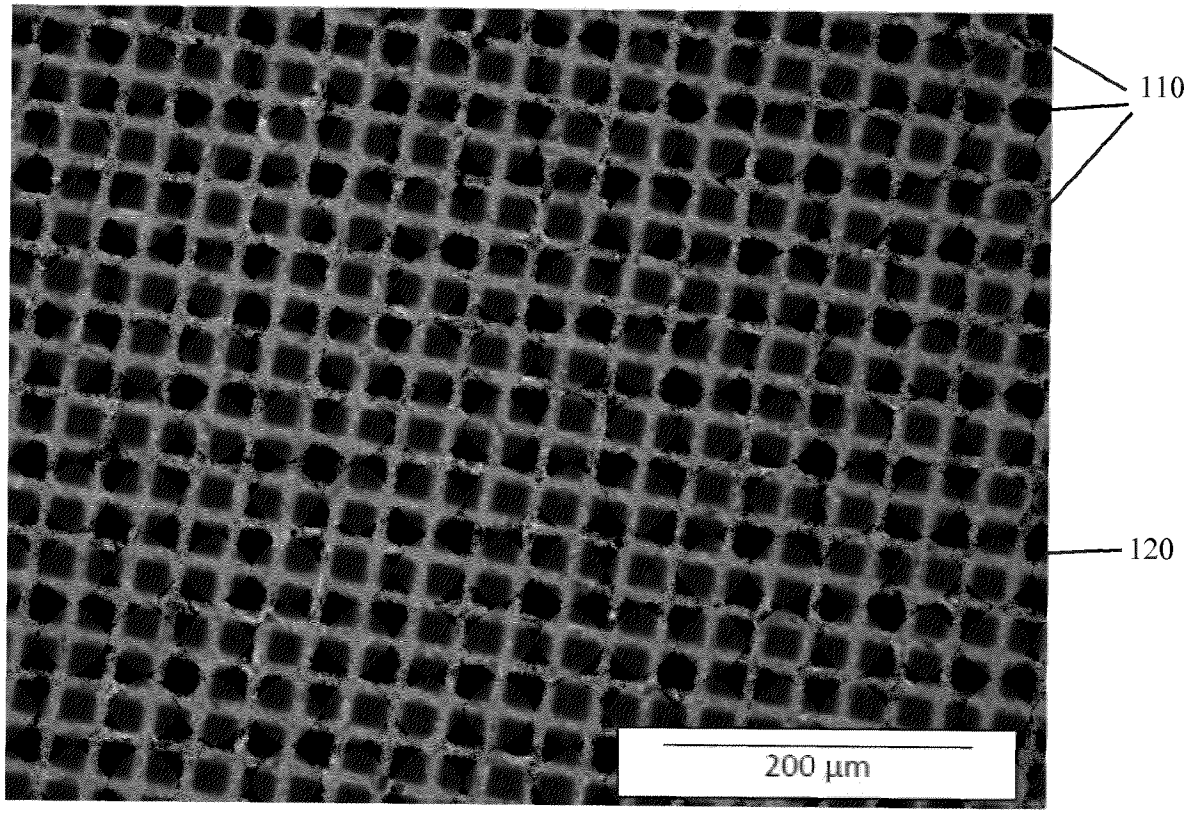
FIG. 4 shows a dark field image of the electron extraction grid with dimensions of a pitch of 25 μm, hole-width of 19 μm and connecting bar thickness of 6 μm.
Figure 5:
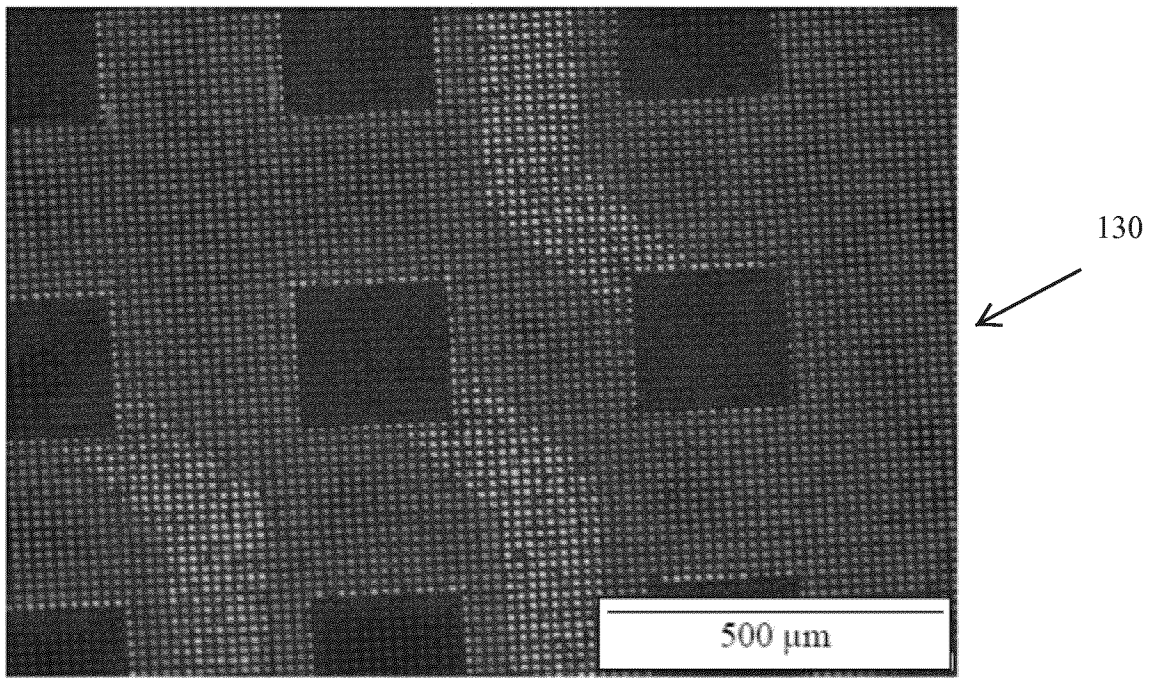
FIG. 5 shows a finished cathode with an integrated electron extraction grid.

A copper layer was chosen as a preferred form of an electron extraction grid 110 material due to its electrical and thermal properties. However, in a most preferred embodiment, in order to improve the copper adhesion characteristics, the thin 50 nm tungsten layer 40 (see FIG. 3) was first sputtered onto the $SiO_2$ surface layer 90. To control the location of the copper electroplating process, a third UV optical lithography was required. In this step, a S-1818 positive photoresist (not shown) was used, allowing for a 1.8-μm thick form of the copper grid 110 with small electron extraction openings 120 as shown in FIG. 4. The copper electroplating was performed using a copper sulfate plating process from Lea Ronal, Inc. An acetone bath was used to strip the photoresist from the surface. The left-over tungsten base plate layer 40 where the grid holes were left from the removal of the photoresist was removed by $SF_6$ RIE. Finally, the $SiO_2$, layer (not shown) under the copper grid 110 was etched to expose the N-UNCD emitters. A buffered oxide etchant (BOE) was used to etch the $SiO_2$ layer and complete the fabrication process of the N-UNCD field emission arrays 130 shown in FIG. 5.

Figure 6B:
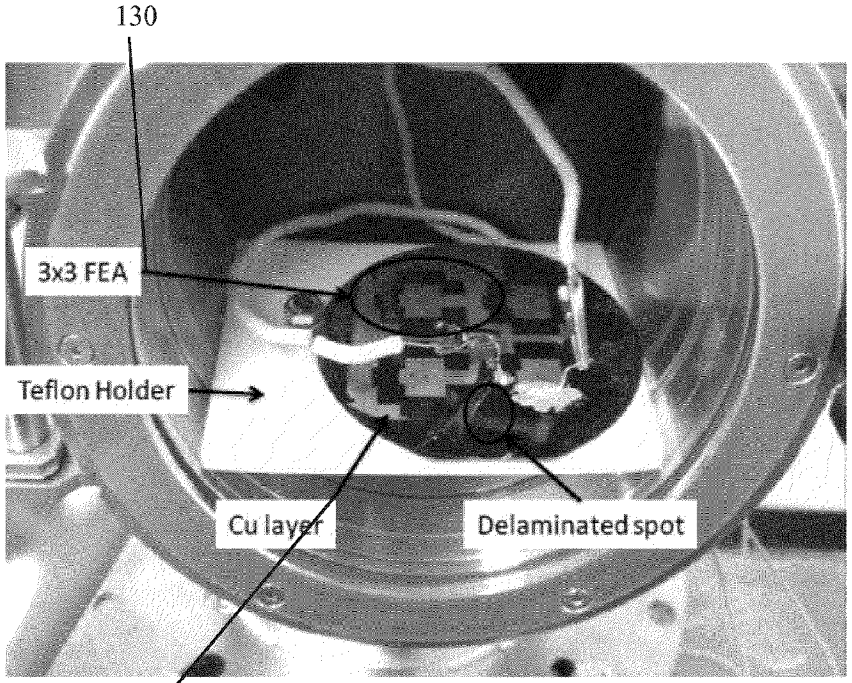
FIGS. 6(*a*) and (*b*) show micro fabricated N-UNCD 3×3 field emitter arrays with FIG. 6(*a*) showing FEA components, including Cu wires connected to the sample using silver epoxy and FIG. 6(*b*) shows a prototype placed inside vacuum chamber.
Figure 6A:
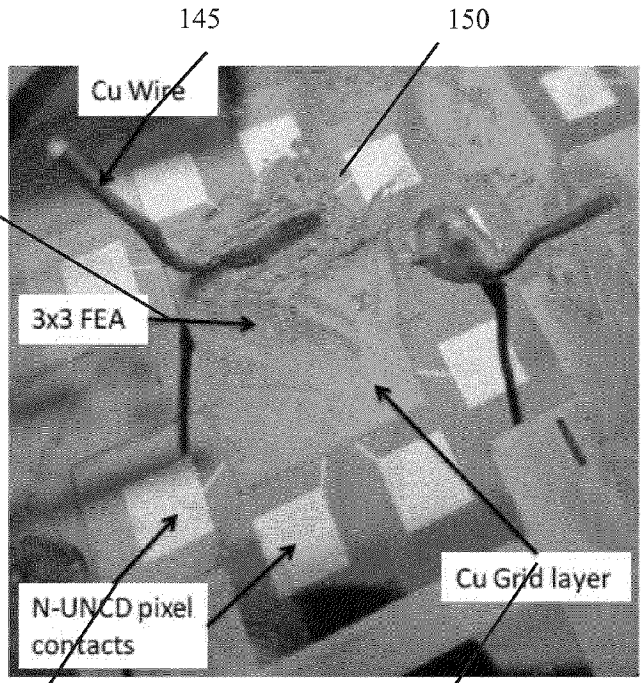

The electron emission characteristics of the micro fabricated field emitter arrays 130 (FEA) were evaluated by measuring their current-voltage behavior. For the experiments, the sample consisting of four 3×3 FEA 130 was placed on an electrically insulated Teflon table 140, as shown in FIG. 6(*b*). The N-UNCD pixels and extraction grid contacts 140 were connected to AWG 20 (0.032 in) Oxygen-free (OFHC) copper wires 145 using silver epoxy 150 as shown, see FIG. 6(*a*). Before the I-V measurements were performed, the electrical contacts of the FEA 130 were tested, and some pixels were found to be short-circuited. This short-circuit problem is related to copper delamination issues and subsequent harsh undercut to the $SiO_2$ where the copper layer is missing, leaving the underlying material exposed. After the electrical connections were made to the working pixels, a turbo pump was used to evacuate the vacuum chamber. The field emission experiments were conducted at a pressure below 4×10 Torr.

For the current-voltage measurements the grid 110 was electrically grounded; and the voltage fed to the N-UNCD cathode was varied from 0 V to −140 V. The emission currents, I, at the grid 110 was recorded as the cathode voltage was varied. In this experiment two grids were tested and compared: (1) the electroplated copper grid 110 (EP Grid) shown in FIG. 4, which was monolithically fabricated according to the procedure presented hereinbefore, and (2) a 1000 mesh TEM copper grid (TEM Grid) which was attached to the copper electroplated layer using silver epoxy. The distance between the N-UNCDs and the EP grid is 5 μm, while the distance between the N-UNCDs and the TEM Grid is 7 μm. These values of the cathode-grid gaps were used to estimate the externally applied electric field (E) in Eq. 1. The difference in the gap sizes between the cathode and the grid configurations (1) and (2) is due to the fact that the TEM grid was attached on top of the 2 micrometer copper electroplated layer, while the EP grid is part of the copper electroplated layer itself.

Figure 7:
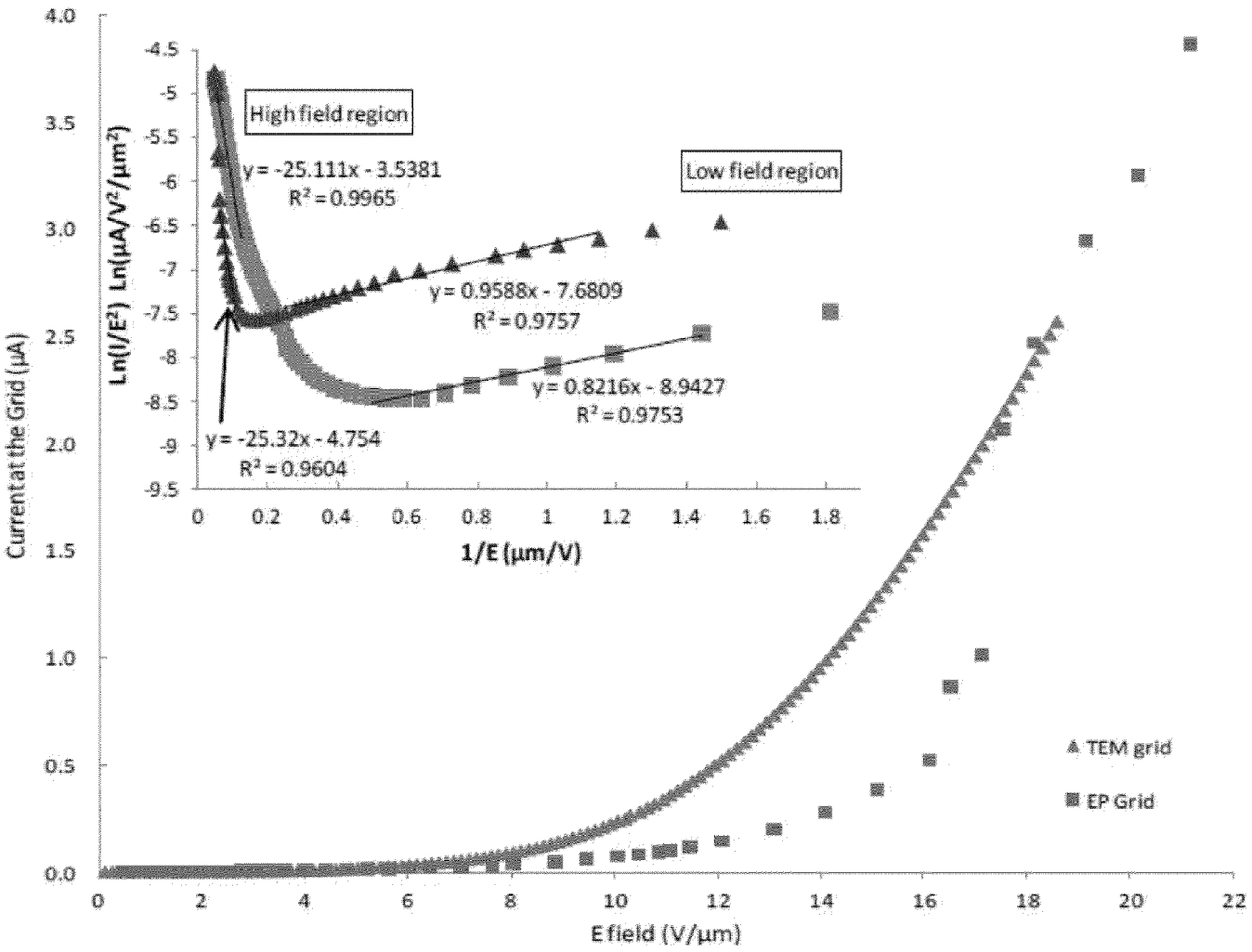
FIG. 7 shows I-V characteristics of field emitted electrons from given N-UNCD pixels and the inset drawing shows: Fowler-Nordheim plots of the different cathode-grid configurations tested.

The measured I-V behavior of the two cathode-grid configurations tested is presented in FIG. 7. As shown, the emission current per pixel measured at the grid 110 was approximately of the order of 2 μA. Based on the I-V measurements, the N-UNCDs field emission characteristics were evaluated according to the Fowler-Nordheim (FN) equation.

$$I - \frac{AFN(\beta E)^2 A}{\phi N\text{-}UNCD}\exp\left(\frac{-\beta FNv(y)\phi\frac{3/2}{N\text{-}UNCD}}{\beta E}\right) \tag{1}$$

In Eq. 1, I is the emission current (μA), E is the electric field applied between the cathode and extraction grid (V/μm), β is the geometrical field enhancement factor of the emitting surface, ØN-UNCD is the work function of the emitting material (eV), $A_{FN}$ is equal to 1.5415 (μA eV $V^{-2}$), $B_{FN}$ is equal to $6.830\times10^3$ ($eV^{-3/2}$ V $\mu m^{-1}$) and A ($\mu m^2$) is the emitting area. The parameter υ(y) within the exponential term in Eq. 1 corresponds to a correction function due to image force effects and is taken as one for carbon based emitters. The FN plots of the two cathode-grid configurations tested are shown as an inset in FIG. 7. In this figure, ln ($I/E^2$) is plotted as a function of 1/E.

Two regions can be clearly identified in the FN plots presented in FIG. 7, a high field region and a low field region. For the two cathode-grid configurations tested, the data in the low and high field regions were fitted to linear functions. The turn-on electric field ($E_0$) for the embodiment was calculated by finding the intercept between the linear functions obtained for the high and low field regions The values obtained for the turn-on electric field are presented in Table I; and they are in general agreement with results reported in the literature for similar systems. Furthermore, the field emission parameters of the N-UNCD samples were extracted from the linear function fitted to the data in the high field region of the ln $(1/E^2)$ versus 1/E FN plot, as shown in FIG. 8.

Based on Eq. I, the work function (ØN-uNco and the geometrical field enhancement factor (β) of our N-UNCD samples can be related to the slope of the high field regions by the equation:

$$Slope_{FN} = \frac{\partial 1n(1/E^2)}{\partial(1/E)} = \frac{-\beta FN\theta \frac{3/2}{N\text{-}UNCD}}{\beta} \quad (2)$$

Figure 8:
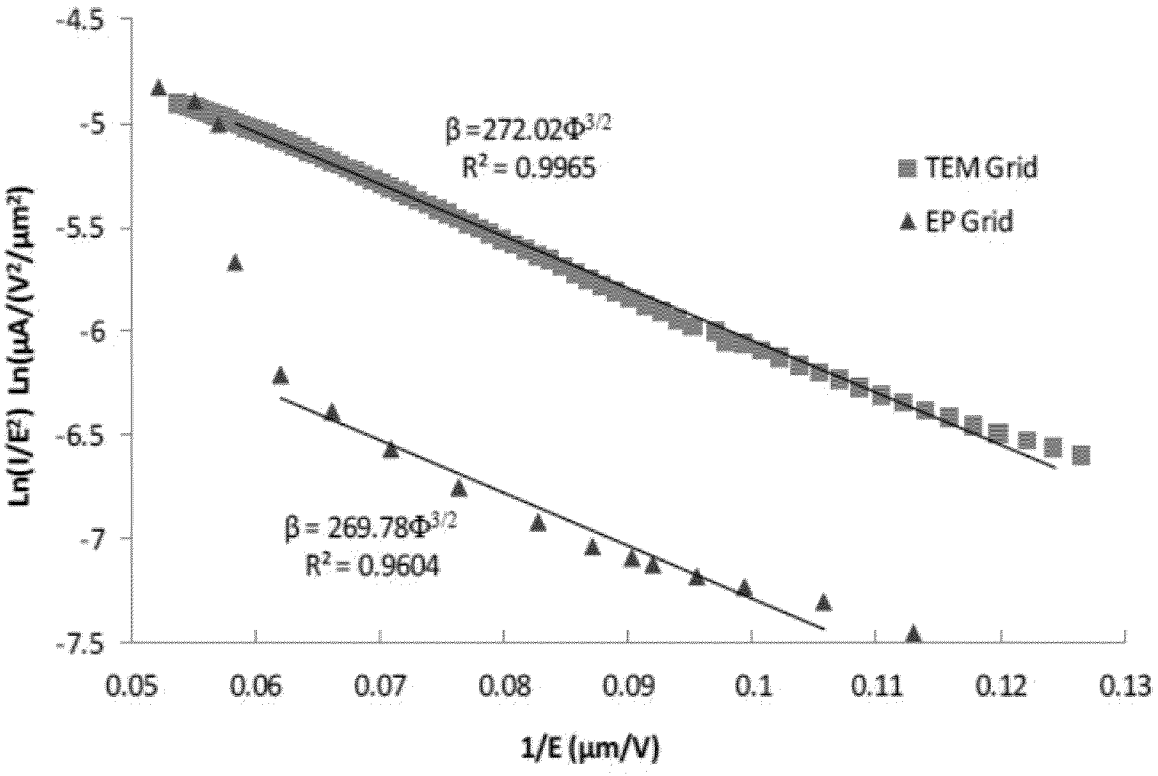
FIG. 8 shows F-N plots indicating β as a function of ØUNCD for the two cathode-grid configurations tested.

Therefore, Eq. 2 is used in combination with the slopes of the FN plots shown in FIG. 8 to determine the N-UNCDs effective work function defined in Eq. 3. Results obtained are presented in the Table below and are in agreement with values reported in the literature for similar systems.

$$\phi_\varepsilon = \frac{\phi \frac{3/2}{\text{N-UNCD}}}{\beta} \quad (3)$$

| | $E_o$ (V/μm)[a] | $J_e$ (mA/cm$^2$)[b] | $\phi_e$ (eV)[c] |
|---|---|---|---|
| TEM Grid | 6.29 | 5.37 | 0.0036 |
| EP Grid | 6.24 | 6.42 | 0.0037 |

[a]Estimated by the intersection of the high and low fields
[b]Emission current density at 20 V/μm
[c]Effective work function estimated from the FN plots In FIG. 8 the corresponding FN plot for the EP Grid sample showed a deviation from linearity at high electric fields. This deviation from linearity could be due to any remnant $SiO_2$ between the EP grid and the N-UNCDs layer, which thus reduces the available emission area and affects the effective electric field on the surface of the emitter's layer due to the finite resistance of the $SiO_2$. FIG. 7 shows that the emission current of the EP Grid sample, however, has a behavior similar to the TEM grid sample's emission current.

The instant invention of a method and article includes a 3×3 field emitter array for a flat-panel X-ray source that was successfully fabricated and tested. The results fitted well with previous electron field emission studies. Such an X-ray target with a high voltage connection can be integrated to generate transmission-type X-rays for use in a variety of commercial applications. Depending on the geometry of the given situation a flat-panel source can be used in tomography, radiography, or tomosynthesis. Furthermore, the unit can be used as a portable electron or X-ray scanner or an integral part of an existing detection system. UNCD field emitters show great field emission output and can be deposited over large areas as the case with carbon nanotube "forest" (CNT) cathodes. Furthermore, UNCDs have better mechanical and thermal properties as compared to CNT tips, which further extend the lifetime of UNCD based FEA.

The foregoing description of embodiments of the present invention has been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments, and with various modifications, as are suited to the particular use contemplated.

The invention claimed is:

1. A field emitter array device comprising,
a wafer substrate;
an electrical insulator layer disposed on the wafer substrate;
a plurality of metal tabs for establishing an electrical circuit;
a flat panel emitter layer comprising ultrananocrystalline diamond; and
a two dimensional electron extraction grid disposed above the flat panel emitter layer, thereby forming a two dimensional field emitter array device.

2. The field emitter array as defined in claim 1 wherein the wafer substrate comprises silicon.

3. The field emitter array as defined in claim 1 wherein the electrical insulator layer comprises $Si_3N_4$.

4. The field emitter array as defined in claim 1 further including a collimator, an X-ray target, a focusing electrode, a spacer and a lead shield, thereby forming an X-ray system for inspection of a specimen.

5. The field emitter array as defined in claim 1 wherein the metal tabs comprise tungsten tabs.

6. The field emitter array as defined in claim 1 wherein the electron extraction grid comprises copper.

7. The field emitter array as defined in claim 6 wherein the electron extraction grid includes openings, thereby enabling electron extraction therethrough.

8. The field emitter array as defined in claim 7 having a photoresist layer disposed adjacent the openings.

9. A method of manufacturing a field emitter array device, comprising the steps of,
disposing a wafer substrate for forming the field emitter array device thereon;
forming an electrical insulator layer on the wafer substrate;
forming a plurality of metal tabs on the electrical insulator layer;
forming a flat panel emitter layer comprising at least one of nitrogen incorporated nanocrystalline diamond and boron doped ultrananocrystalline diamond; and
forming above the flat panel emitter layer an electron extraction grid.

10. The method as defined in claim 9 wherein the flat panel emitter layer comprises nitrogen incorporated nanocrystalline diamond.

11. The method as defined in claim 9 wherein the electron extraction grid comprises copper disposed on $SiO_2$.

12. The method as defined in claim 9 wherein the electrical insulator layer is deposited by LPCVD.

13. The method as defined in claim 9 wherein the electrical insulator layer comprises $Si_3N_4$.

14. The method as defined in claim 9 wherein the metal tabs are deposited by at least one of the sputtering and electron beam evaporation.

15. The method as defined in claim 9 further including the step of forming components of an X-ray system coupled to the field emitter array.

16. The method as defined in claim 15 wherein the X-ray system includes a collimator, an X-ray target, a focusing electrode, a spacer and a lead shield, thereby forming an X-ray system for inspection of a specimen.

* * * * *